US011649095B2

(12) United States Patent
Huffer

(10) Patent No.: US 11,649,095 B2
(45) Date of Patent: May 16, 2023

(54) CHILD-RESISTANT CLOSURE

(71) Applicant: Sonoco Development Inc., Hartsville, SC (US)

(72) Inventor: Scott William Huffer, Hartsville, SC (US)

(73) Assignee: SONOCO DEVELOPMENT, INC., Hartsville, SC (US)

( * ) Notice: Subject to any disclaimer, the term of this patent is extended or adjusted under 35 U.S.C. 154(b) by 127 days.

(21) Appl. No.: 17/117,633

(22) Filed: Dec. 10, 2020

(65) Prior Publication Data

US 2022/0185550 A1 Jun. 16, 2022

(51) Int. Cl.
*B65D 50/06* (2006.01)
*B65D 55/12* (2006.01)

(52) U.S. Cl.
CPC ..... *B65D 50/062* (2013.01); *B65D 55/12* (2013.01); *B65D 2215/04* (2013.01); *B65D 2255/20* (2013.01)

(58) Field of Classification Search
CPC .... B65D 50/062; B65D 50/061; B65D 50/06; B65D 50/045; B65D 50/046; B65D 50/041; B65D 41/06
USPC ..... 215/225, 224, 221, 220, 219, 218; 220/301, 300, 293
See application file for complete search history.

(56) References Cited

U.S. PATENT DOCUMENTS

| | | | |
|---|---|---|---|
| 2,226,390 | A | 12/1940 | Rosevear |
| 3,693,820 | A | 9/1972 | Linkletter |
| 3,738,523 | A | 6/1973 | Linkletter |
| 3,811,589 | A | 5/1974 | Thornton et al. |
| 3,850,325 | A | 11/1974 | MacLeod |
| 4,482,068 | A | 11/1984 | Agbay et al. |
| 4,512,485 | A | 4/1985 | Agbay et al. |
| 5,735,417 | A | 4/1998 | Darr et al. |
| 7,007,523 | B2 | 3/2006 | Belden, Jr. |
| 8,517,193 | B1 | 8/2013 | Small |
| 8,875,915 | B2 | 11/2014 | Serell |
| 2006/0231445 | A1 | 10/2006 | Watson |

(Continued)

FOREIGN PATENT DOCUMENTS

| | | | |
|---|---|---|---|
| CN | 2423234 | Y | 3/2001 |
| WO | 2019242602 | A1 | 12/2019 |

OTHER PUBLICATIONS

U.S. Appl. No. 33/779,412, filed Dec. 18, 1973, Kirton.

(Continued)

*Primary Examiner* — Robert J Hicks
(74) *Attorney, Agent, or Firm* — Nelson Mullins Riley & Scarborough LLP

(57) ABSTRACT

The invention comprises a lid configured to close the open end of a container, wherein the lid comprises a track disposed at least partially circumferentially within a peripheral portion of the lid, at least one insertion point within the track, and at least one retention region within the track. A ring is disposed circumferentially about the container, wherein the ring comprises at least one post which is configured to be inserted into and removed from the at least one insertion point and retained within the retention region. At least one of the ring and the lid are circumferentially rotatable between a locked position, wherein the at least one post is within the at least one retention region and an unlocked position, wherein the at least one post is within the at least one insertion point.

17 Claims, 11 Drawing Sheets

(56) References Cited

U.S. PATENT DOCUMENTS

2012/0175336 A1 7/2012 Miller et al.

OTHER PUBLICATIONS

Puzzle Pod Cryptex; 4Thought Products Vino Vault Wine Puzzle; 2 pages; Downloaded on Dec. 9, 2020 from http://puzzle-pod.com/vino-vault/.

Safe RX—Safe Rx Locking Pill Bottle; 8 pages; Downloaded on Dec. 9, 2020 from https://www.amazon.com/Safe-Rx-Combination-Child-Resistant-Senior-Friendly/dp/B0821QK92S/ref=pd_lpo_121_t_1/140-6463045-5891058?_encoding=UTF8&pd_rd_i=B0821QK92S&pd_rd_r=3d675b52-78f6-43a9-b0e2-3b8d19ad4361&pd_rd_w=nR9kH&pd_rd_wg=t2ISd&pf_rd_p=7b36d496-f366-4631-94d3-61b87b52511b&pfr_rd_r=EMAC1KEMSC5X8P51XXVJ&psc=1&refRID=EMAC1KEMSC5X8P51XXVJ.

4Thought Products; Pill Pod Medication/Rx Drug Combination Lock Box; 10 pages; Downloaded on Dec. 9, 2020 from https://www.amazon.com/Pill-Medication-Drug-Combination-Medium/dp/B00ESQJ5D0.

International Search Report and Written Opinion for International application No. PCT/US2021/059072 (09435); dated Mar. 14, 2022; 14 pages.

CHILD-RESISTANT CLOSURE

FIELD OF THE INVENTION

The present invention relates generally to containers and closures for containers, and more particularly, to child-resistant containers and child-resistant closures for containers.

BACKGROUND

Containers are often formed with closures which prevent children from opening products that could be harmful or are not intended for their use (i.e. pharmaceuticals). A common child-resistant mechanism comprises a press-to-open feature which prevents or inhibits removal of the closure unless the required amount of force is applied onto the closure while simultaneously rotating the closure in the correct direction. This poses disadvantages, however, as these closures are often compromised by children and are, conversely, difficult for senior citizens to open.

The present inventors, through ingenuity and hard work, have developed a container and closure combination which provides child-resistance without requiring a downwardly-applied force, thereby avoiding the disadvantages set forth above.

BRIEF SUMMARY

In an embodiment, the invention is directed to a container system comprising: a container body having a base, at least one sidewall extending upwardly from the base, and a rim disposed opposite the base, wherein the rim defines an open end of the container; a lid configured to close the open end of the container, wherein the lid comprises: a track disposed at least partially circumferentially within a peripheral portion of the lid; at least one insertion point within the track; and at least one retention region within the track; a ring disposed circumferentially about the at least one sidewall, between the rim and the base, wherein the ring comprises at least one post which is configured to be inserted into and removed from the at least one insertion point and retained within the retention region; wherein at least one of the ring and the lid are circumferentially rotatable between a locked position, wherein the at least one post is within the at least one retention region and an unlocked position, wherein the at least one post is within the at least one insertion point.

In another embodiment, the invention comprises: a container body having a base, at least one sidewall extending upwardly from the base, and a rim disposed opposite the base, wherein the rim defines an open end of the container; a ring disposed circumferentially about the at least one sidewall, between the rim and the base, wherein the ring comprises: a track disposed at least partially circumferentially within the ring; at least one insertion point within the track; and at least one retention region within the track; a lid configured to close the open end of the container, wherein the lid comprises at least one post which is configured to be inserted into and removed from the at least one insertion point and retained within the retention region; wherein at least one of the ring and the lid are circumferentially rotatable between a locked position, wherein the at least one post is within the at least one retention region and an unlocked position, wherein the at least one post is within the at least one insertion point.

In another embodiment, the invention comprises a lidded locking mechanism comprising: a lid configured to close the open end of a container, wherein the lid comprises: a track disposed at least partially circumferentially within a peripheral portion of the lid; at least one insertion point within the track; and at least one retention region within the track; a ring configured to be disposed circumferentially about the container, wherein the ring comprises at least one post which is configured to be inserted into and removed from the at least one insertion point and retained within the retention region; wherein at least one of the ring and the lid are circumferentially rotatable between a locked position, wherein the at least one post is within the at least one retention region and an unlocked position, wherein the at least one post is within the at least one insertion point.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION

Figure 1:
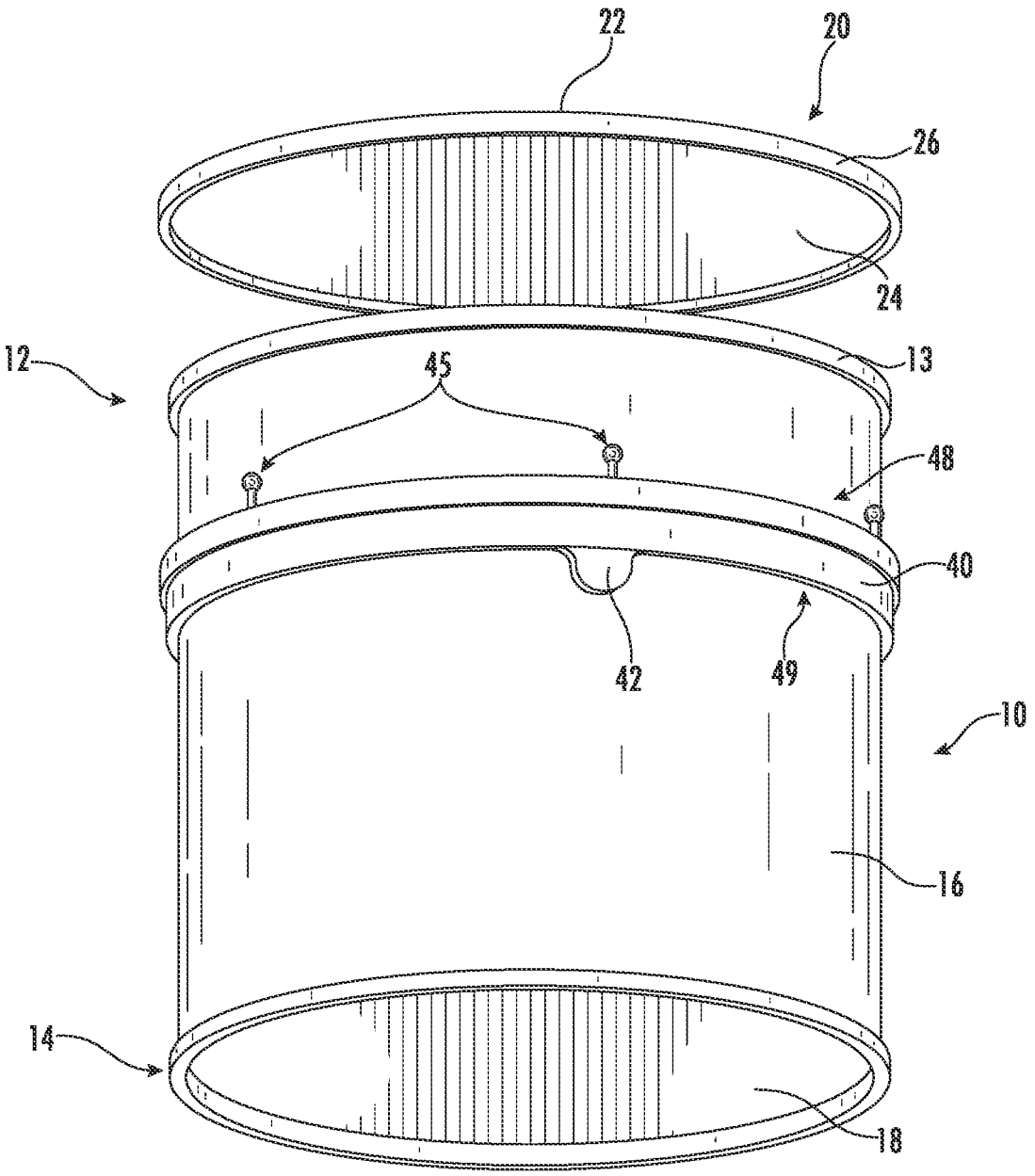
FIG. 1 is a front perspective view of a container in an embodiment of the present invention.

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Generally speaking, the invention comprises a container which requires the correct alignment of a lid and peripheral ring to open the container. In an embodiment, the correct alignment is visually indicated by a code (i.e. "align X with 7"). The visual code may ensure that achieving the correct alignment is difficult for a person who cannot read, such as a child. Internally, the lid and ring may comprise a track and rail system. The correct alignment may require aligning a post in the rail member with a cavity in the track member such that the post may be removable through the cavity and, therefore, the lid and ring may be separated so that the lid can be removed. In an unaligned configuration, the post may be locked into the track member, preventing removal of the lid. The rail or the track may be disposed in the lid and the opposite member may be disposed in the ring.

Referring to the drawings, in an embodiment, the invention involves a cylindrical container 10 enclosed at its top end 12 by a disc-shaped lid 20. In an embodiment, the container 10 may comprise a body portion comprising at least one sidewall 16 which extends upwardly from a generally flat bottom wall 18. The bottom wall 18 may enclose the bottom end 14 of the container 10. The bottom wall 18 may be permanently affixed to the bottom end 14 of the container 10 in an embodiment. In other embodiments, the bottom wall 18 may be removable. In one embodiment, the bottom wall 18 may have a larger diameter than the sidewall 16 of the container 10 (i.e. such as in the case of a double-crimped end), but in other embodiments the bottom wall 18 may have the same or substantially the same diameter as the sidewall 16 of the container 10. That is, in some embodiments, the perimeter of the bottom wall 18 is flush with or substantially flush with the outer surface of the sidewall 16. In embodiments wherein the bottom wall 18 has the same or substantially the same diameter as the sidewall 16, the slide ring 40 (discussed below) may be fully removed from the container by sliding it downwardly against the sidewall 16 and over the bottom wall 18.

In an embodiment, the container 10 comprises an open top end 12 and an upper rim 13. The rim 13 may comprise an integral rolled rim (i.e. in the case of a composite cylindrical container) or a separately-applied rim. As an example, a separately-applied rim may comprise an easy-open (EZO) end (see FIGS. 1-4). The rim 13, in an embodiment, has a larger diameter than the sidewall 16 of the container 10.

While the container is described as having a generally cylindrical sidewall 16, any shape or configuration of the container may be utilized in the invention. For example, the container may have four sidewalls and a rectangular or square cross-section. The container may have three sidewalls and have a generally triangular cross-section. The container may have an ovular or elliptical cross-section in various embodiments.

Likewise, any composition of materials may be useful to form the container sidewall 16, bottom wall 18, and lid 20. For example, the container sidewall 16 may be paper-based, the bottom wall 18 may be paper-based or metal, the lid 20 may be plastic or paper, etc. Any combination of paper-based materials, plastic-based materials, or metal-based materials may be utilized for any one of the sidewall 16, bottom wall 18, and lid 20. The container may comprise a composite container in some embodiments. The container, bottom, and lid may all be plastic components in an embodiment. The container, bottom, and lid may all be paper-based components in an embodiment. In an embodiment, the sidewall 16 and bottom end 18 may be paper-based and the lid 20 and the slide ring 40 may be plastic.

In an embodiment, the lid 20 may be shaped and configured to fit onto the top end 12 of the container 10, over the rim 13. The lid 20 may have a shape and diameter which is configured to snap-fit onto the rim 13 of the container 10. In an embodiment, the lid 20 may be the same shape as the container. Thus, if the container is cylindrical, the lid may comprise a circular disc shape. In some embodiments, the lid 20 may have an upper or outer surface 22 and a lower or inner surface 24. The inner surface 24 may be the product-facing surface and the outer surface 22 may be the consumer-facing surface of the lid.

The lid 20 may be reclosable in some embodiments. That is, after initial removal of the lid 20 from the container 10, the lid may be replaced onto the rim 13 of the container 10 through a snap-fit or other connection.

In an embodiment a peelable membrane (not shown) may be adhered to the rim 13 of the container 10, between the lid 20 and the container 10. The peelable membrane may be removable and the lid 20 may be replaced upon the rim 13 after removal of the membrane, in some embodiments.

Figure 3:
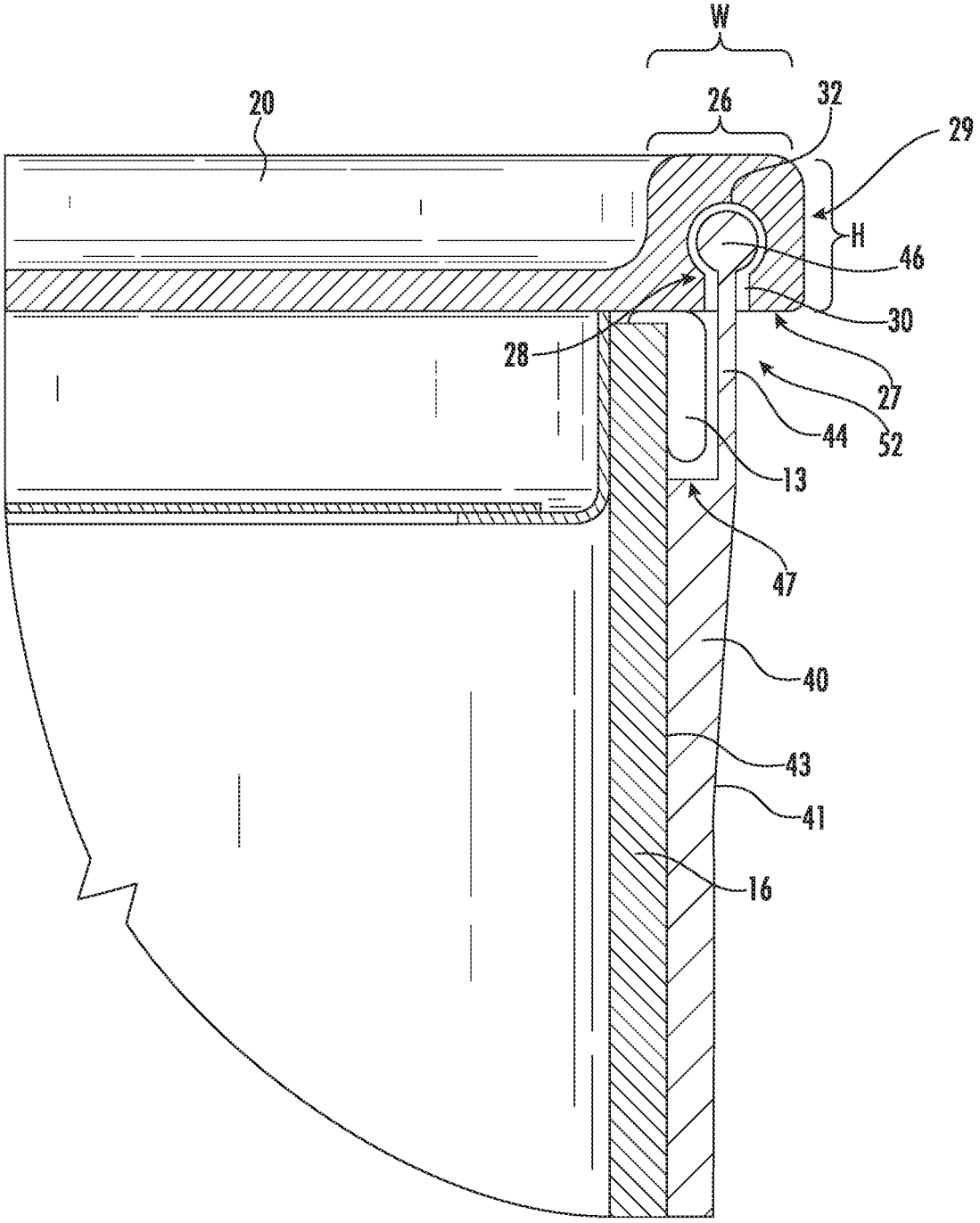
FIG. 3 is cross sectional view of a container in an embodiment of the present invention.
Figure 4:
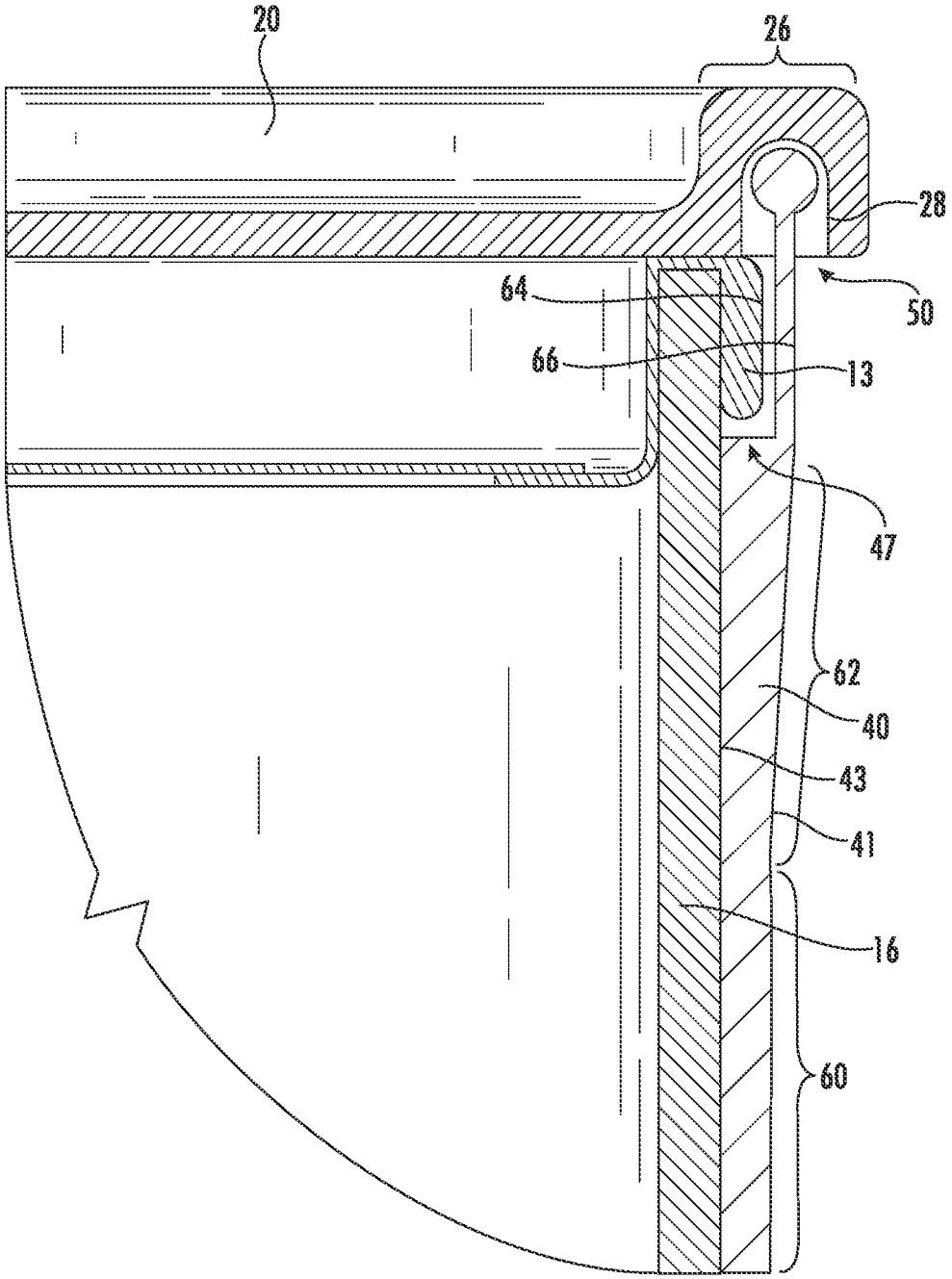
FIG. 4 is cross sectional view of a container in an embodiment of the present invention.
Figure 5:
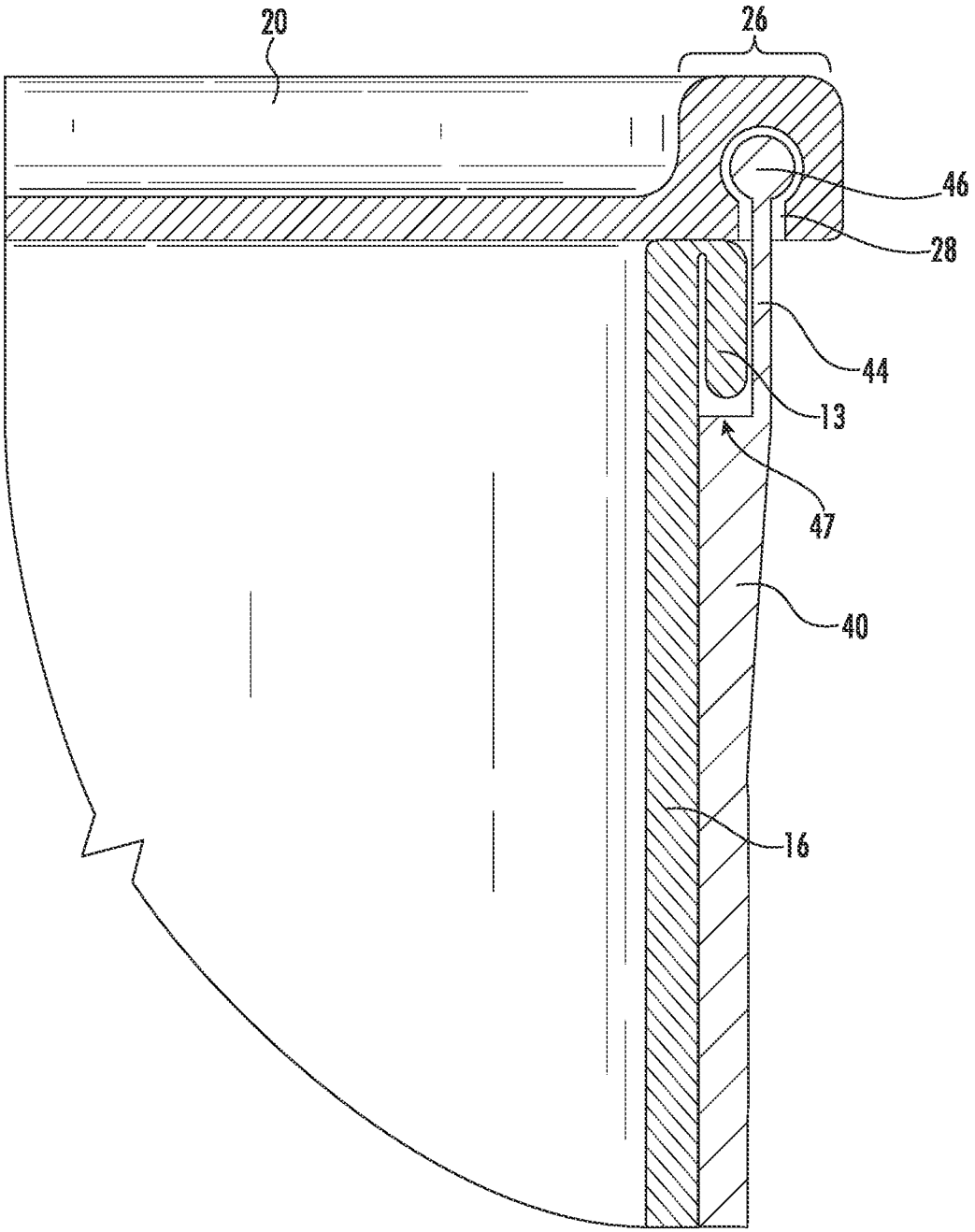
FIG. 5 is cross sectional view of a container in an embodiment of the present invention.

In an embodiment, the lid 20 may comprise a downwardly-extending (vertically toward the container) flange. The flange may be shaped and configured to snap-fit over the rim 13 of the container 10. In other embodiments, the lid 20 may be configured to rest atop the rim 13 of the container, as shown in FIGS. 3-4.

In an embodiment, the lid 20 comprises a peripheral portion 26 which extends about its circumference. The peripheral portion 26 of the lid 20 may comprise a height H (which may be the same height as the lid 20) and a width W. The lid 20 may have a diameter (i.e. width) which is larger than the diameter of the outer surface of the sidewall 16, in an embodiment. The width W of the peripheral portion 26 may comprise the distance from approximately the exterior surface of the container sidewall 16 to the outermost edge 29 of the lid 20. The peripheral portion 26 of the lid 20 may extend radially outwardly beyond the circumference of the sidewall 16, in an embodiment.

In an embodiment, the peripheral portion 26 of the lid 20 (which may comprise a flange) may comprise an internal track 28. The track 28 may be disposed within the peripheral portion 26. Access to the track 28 may be disposed on the underside 27 of the peripheral portion 26 of the lid 20.

The track 28 may be circumferential within the peripheral portion 26 of the lid 20, in an embodiment. In other embodiments, the track 28 may be partially or substantially circumferential within the peripheral portion 26 of the lid 20. The track 28 may comprise a plurality of partially circumferential tracks 28 in an embodiment. For example, two or three separated tracks 28 may be disposed about the circumference of the peripheral portion 26 in an embodiment.

The track 28 may comprise a hollow recess into or within the peripheral portion 26 of the lid. In an embodiment, the track 28 is disposed radially outward of the sidewall 16 of the container 10. In an embodiment, the track 28 is disposed vertically above the sidewall 16 and/or the rim 13 of the container 10.

In an embodiment, the track 28 comprises a neck-receiving portion 30 and a head-receiving portion 32. The neck-receiving portion 30 may be narrower than the head-receiving portion 32 of the track 28. The neck receiving portion 30 and head-receiving portion 32 of the track 28 may each have a substantially uniform width, height and depth, progressing circumferentially about the peripheral portion 26.

In an embodiment, the head-receiving portion 32 of the track 28 may be generally cylindrical and circular in cross section (see FIG. 3). In an embodiment, the head-receiving portion 32 of the track 28 may be sized and configured to receive a generally spherical head of a post.

In an embodiment, the neck-receiving portion 30 may be a three-dimensional rectangle or square and may have generally parallel sidewalls in cross section (see FIG. 3). In an embodiment, the neck-receiving portion 30 may be sized and configured to receive an elongated neck of a post.

Figure 6A:
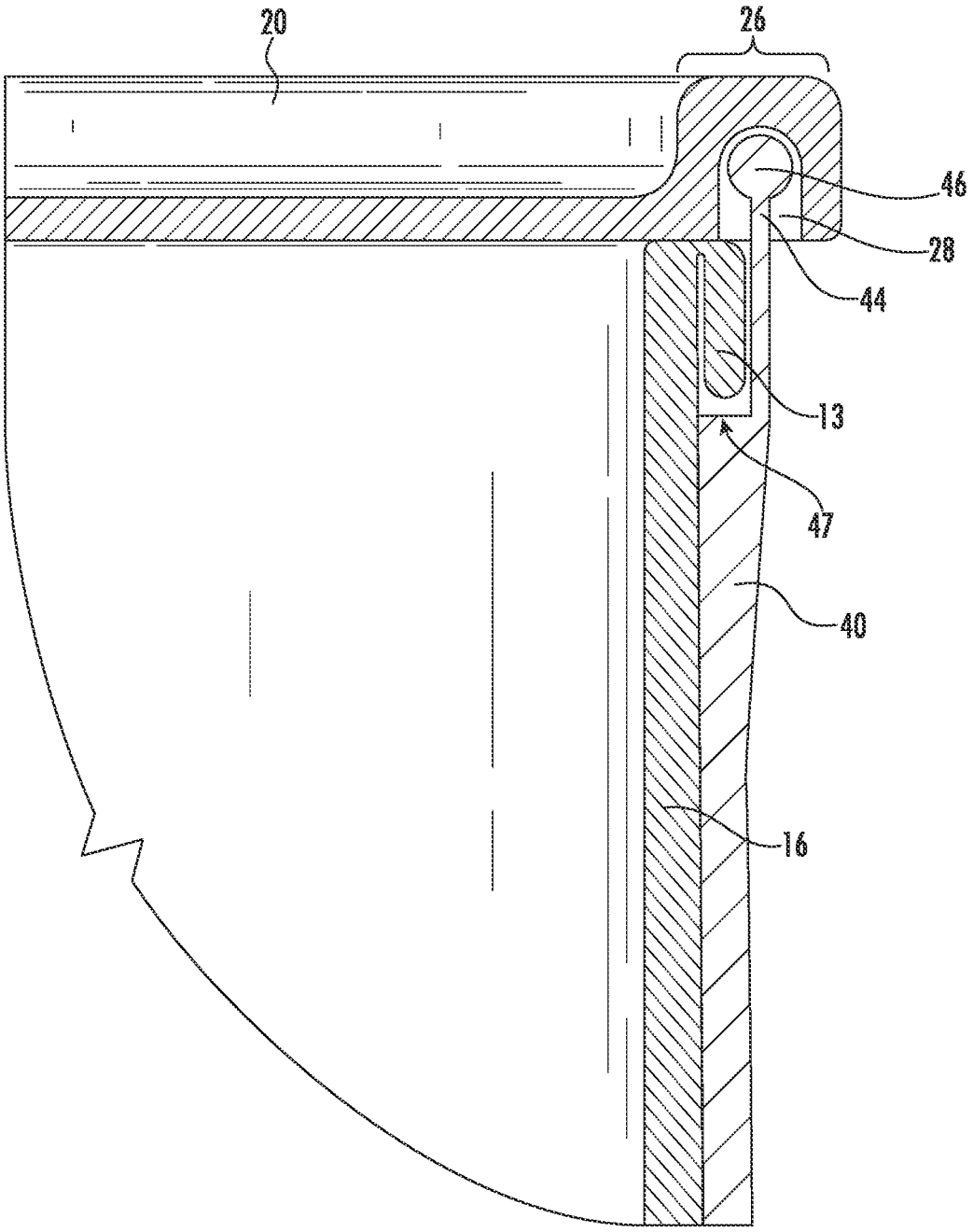
FIGS. 6A-6C are cross sectional views of a container in an embodiment of the present invention.
Figure 6B:
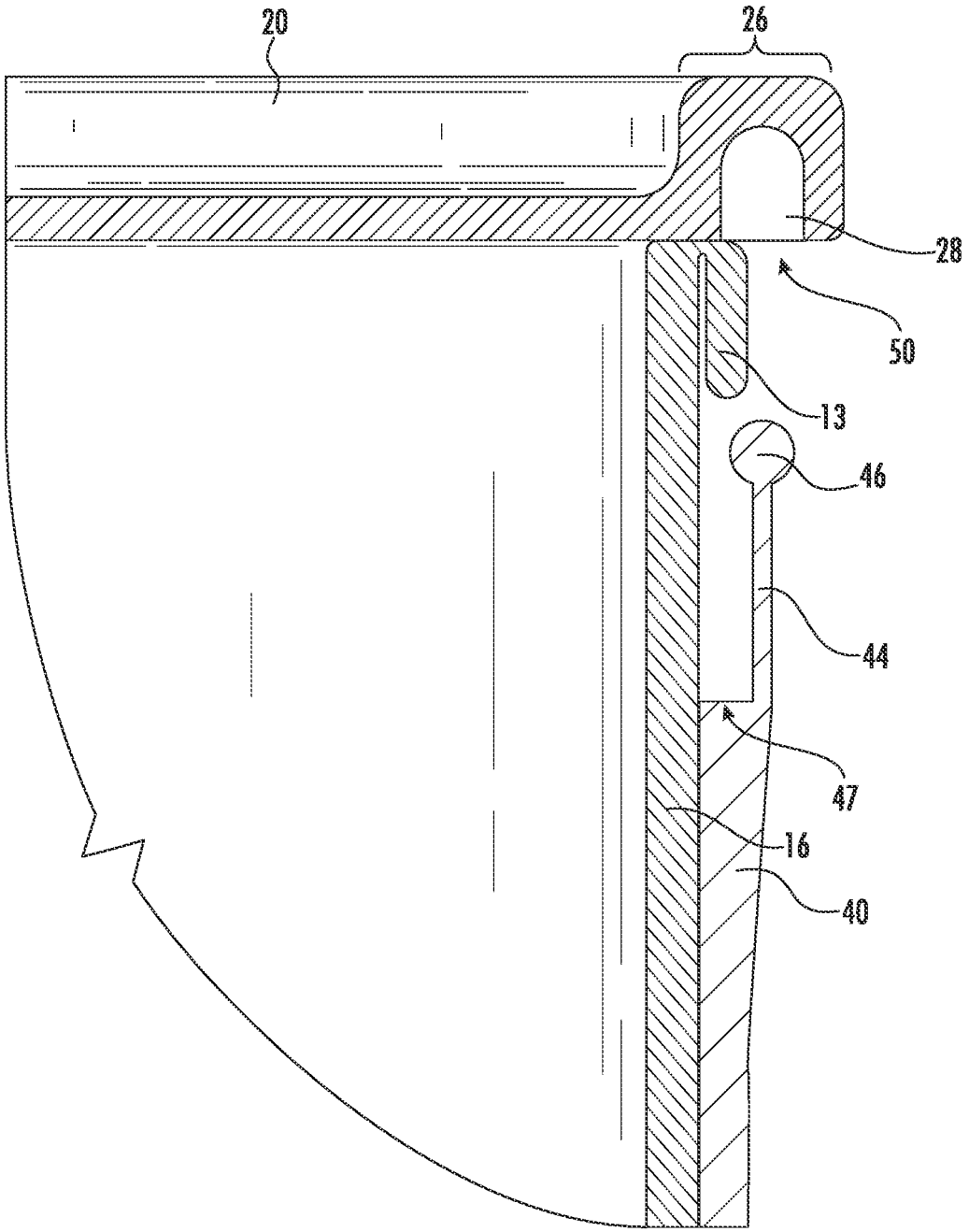

In an embodiment, the track 28 may comprise one or more cavities or insertion points 50 (see FIG. 6B). The insertion point 50 of the track 28 may have the same or a similar size, shape and configuration as the head-receiving portion 32 of the track 28. That is, the insertion point 50 may not have a neck-receiving portion 30 and may instead extend vertically downwardly from the head-receiving portion 32 of the track 28 in a manner which is parallel to the diameter of the head-receiving portion 32. Said alternatively, the neck-receiving portion of the insertion point 50 may be sized and shaped equivalently to the head-receiving portion 32. In an embodiment, the insertion point 50 may be substantially cylindrical and hollow. The insertion point 50 of the track 28 may be sized and configured to allow the head 46 of the post 52 to be inserted or removed from the track 28. In an embodiment, the system may comprise a plurality of insertion points 50. In a particular embodiment, the system may comprise at least two insertion points 50.

Figure 6C:
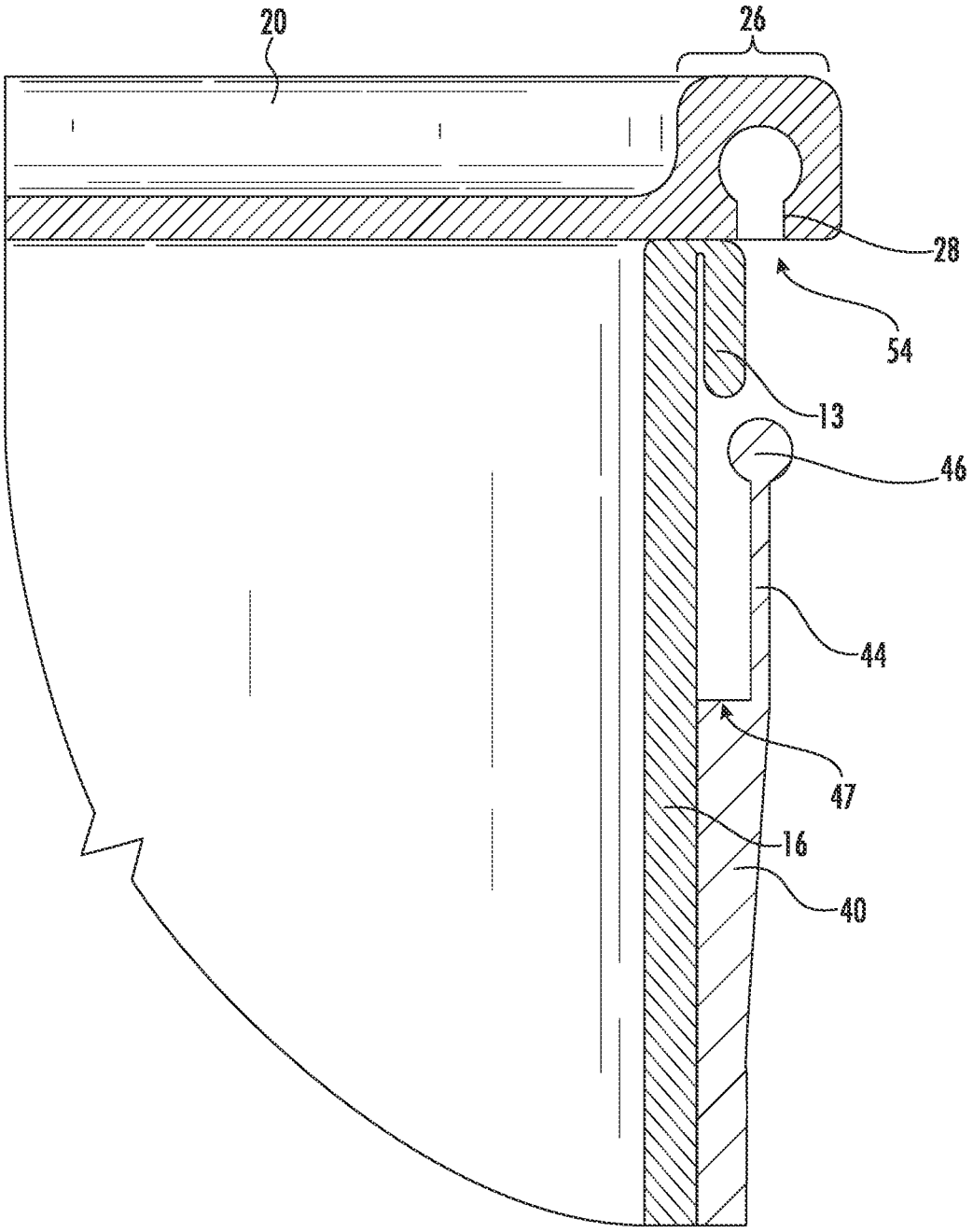
Figure 7A:
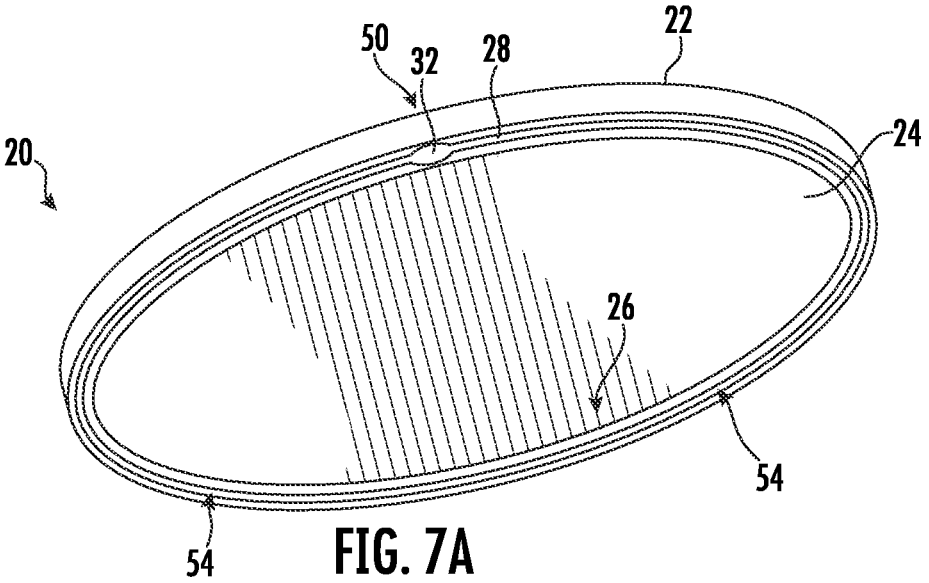
FIGS. 7A-7B are perspective views of lids in an embodiment of the present invention.
Figure 7B:
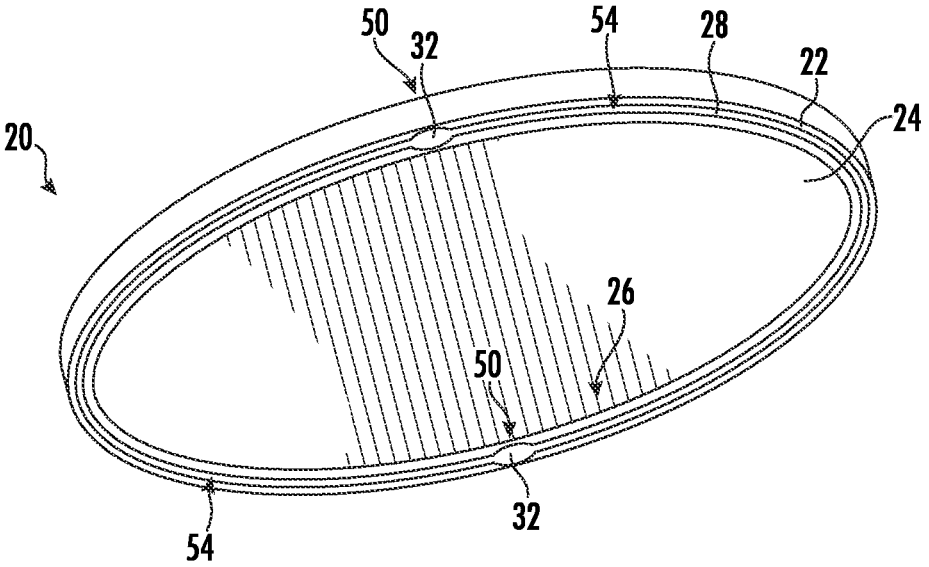
Figure 8:
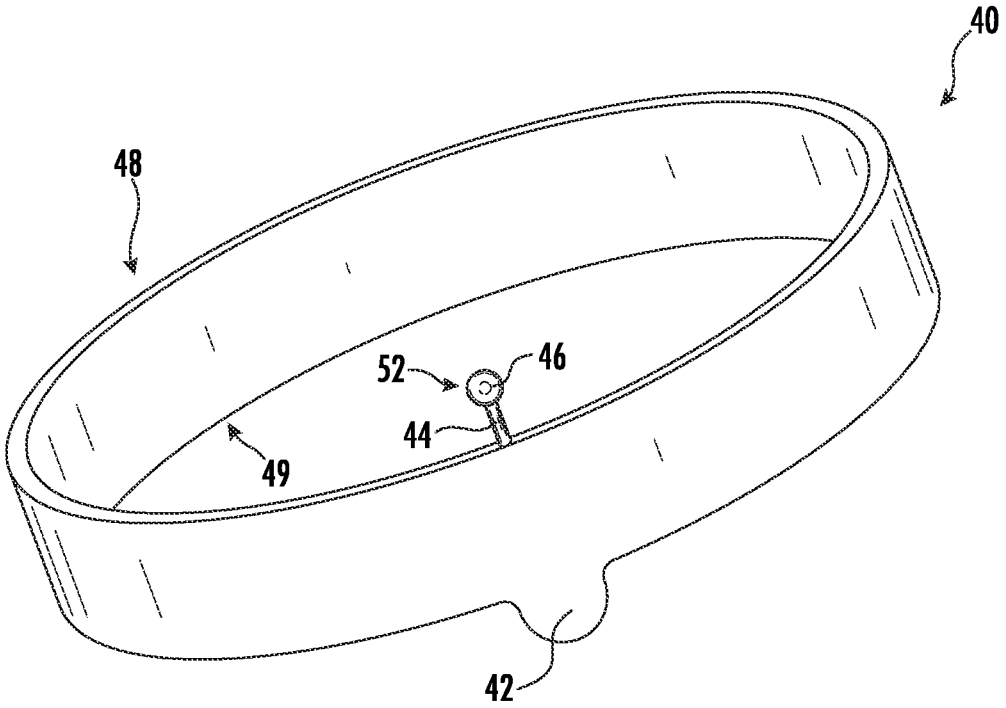
FIG. 8 is a perspective view of a ring in an embodiment of the present invention.
Figure 9:
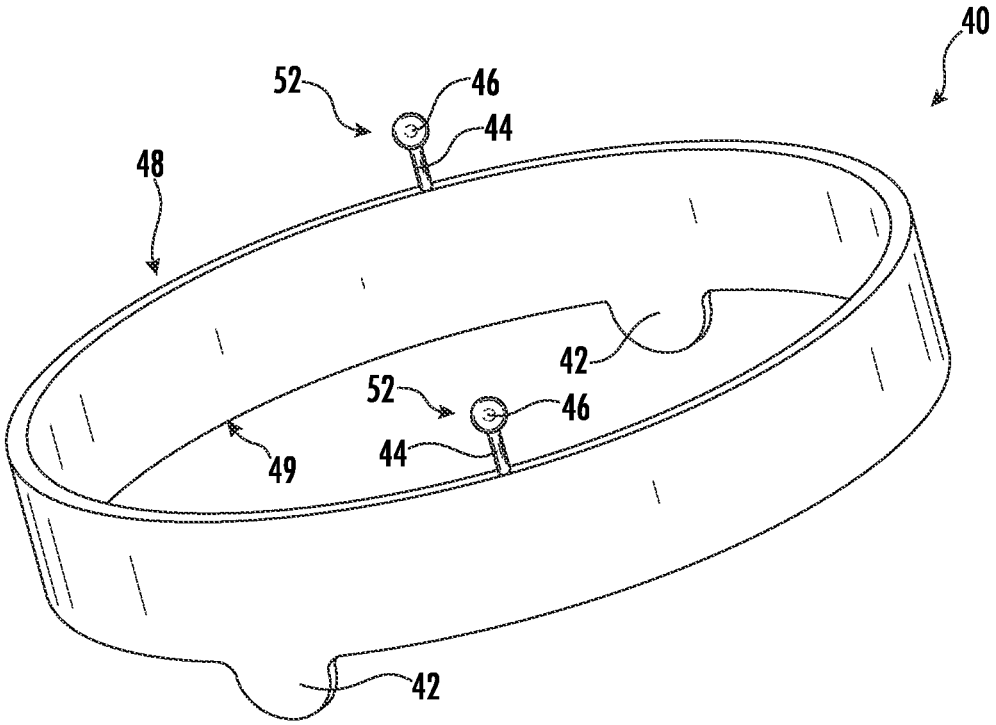
FIG. 9 is a perspective view of a ring in an embodiment of the present invention.

In an embodiment, the portions of the track 28 which are not insertion points 50 may be referred to as retention points 54 or retention regions 54 (see FIG. 6C). Retention points or regions 54 within the track 28 may retain the post 52 (described below) in position within the track 28. Retention points or regions 54 may not allow insertion of the post 52 into the track 28 or removal therefrom.

In an embodiment, the container assembly additionally comprises a peripheral slide ring 40. The slide ring 40 may be disposed on the exterior surface of the container sidewall 16, in an embodiment. The slide ring 40 may be shaped and configured to slide upwardly and downwardly, vertically, along the exterior surface of the container sidewall 16, in an embodiment. The slide ring 40 may also be shaped and configured to slide or rotate circumferentially along the exterior surface of the container sidewall 16 (i.e. clockwise or counterclockwise) in some configurations. In an embodiment, the slide ring 40 is cylindrical and/or mirrors the shape of the container sidewall 16. In some embodiments, the diameter of the slide ring 40 is larger than the diameter of the container sidewall 16 such that the slide ring 40 slides or rotates smoothly about the container sidewall 16. In some configurations, the slide ring 40 may be removable over the bottom end 18 of the container. Once disconnected from the lid 20 (see FIG. 6B and will be further explained), the slide ring 40 may slide downwardly along the sidewall 16 and over the bottom end 18 to be recycled or otherwise discarded. In an embodiment, the slide ring 40 may comprise a polymeric material, a paper-based material, or a combination thereof.

The vertical height of the slide ring 40 may vary based upon the container 10 height or any other factor known in the art. In an embodiment, the height of the ring 40 is small compared to the height of the sidewall 16. In an embodiment, the height of the ring 40 is configured so that the ring 40 can be easily manipulated by a user using the methods set forth herein.

In an embodiment, the slide ring 40 comprises several regions along its vertical height. In an embodiment, the slide ring 40 may comprise a parallel region 60 near its lower end (nearest the base 18). The parallel region 60 may have an internal surface 43 and an external surface 41 which are parallel to each other and to the sidewall 16 of the container. In this parallel region 60, the internal surface 43 and external surface 41 of the ring 40 may be vertical. Above the parallel region 60, the ring 40 may comprise a thickened region 62. The thickened region 62 may comprise an internal surface 43 which is parallel to the container sidewall 16, but an external surface 41 which extends angularly away from the container sidewall 16 such that the thickened region 62 is thicker in cross-section than the parallel region 60.

Figure 2:
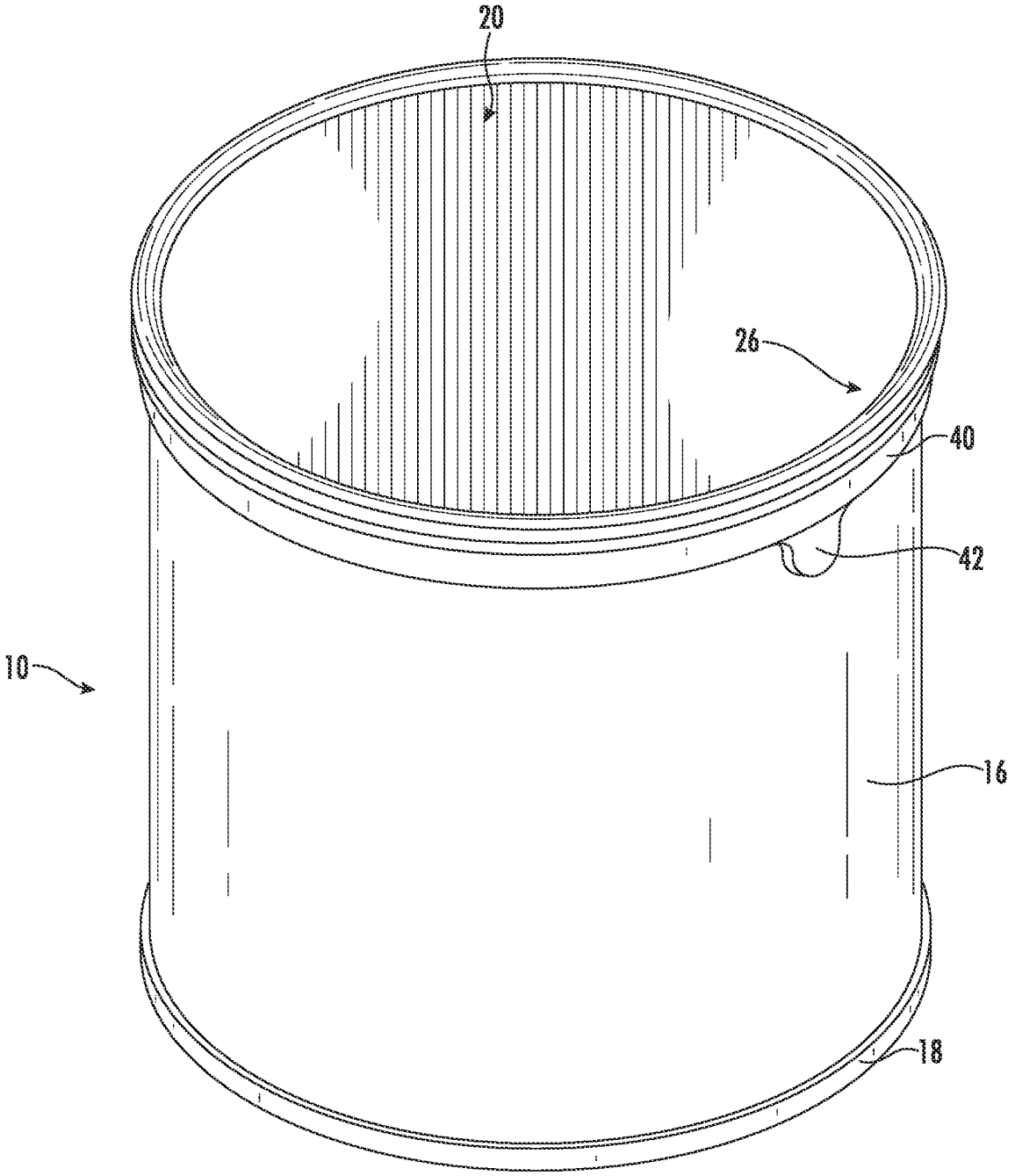
FIG. 2 is a front perspective view of a container in an embodiment of the present invention.

In an embodiment, the slide ring 40 comprises at least one thumb tab 42 (see FIG. 1-2). The thumb tab 42 may extend vertically downwardly from the circumferential ring portion of the slide ring 40. The thumb tab 42 may be disposed on the lower side 49 of the slide ring 40, closer to the bottom wall 18 of the container 10. In an embodiment, the thumb tab 42 may extend downwardly from the parallel region 60 of the slide ring 40. The thumb tab 42 may be any shape or configuration known in the art. In an embodiment, the thumb tab 42 may be semi-ovular, semi-circular, square, or rectangular. In an embodiment, the thumb tab 42 may be sized to accommodate the size of an average adult's thumb or finger. In an embodiment, the exterior surface of the thumb tab 42 may have ridges or a texture which improves the gripability of the thumb tab 42.

In an embodiment, the thumb tab 42 is designed to allow the user to maintain the position of the slide ring 40 against the container sidewall 16 while twisting the lid 20 circumferentially (clockwise or counterclockwise). In an embodiment, the user depresses the at least one thumb tab 42 against the sidewall 16, which causes the ring 40 to resist circumferential movement. The lid 20 is then twisted with the opposite hand to align the locking/unlocking mechanism of the invention. The lid 20 can be removed from the container 10 once the lid and ring are unlocked.

Alternatively, the thumb tab(s) 42 could be utilized to grasp and circumferentially rotate the ring 40 while maintaining the circumferential position of the lid with the opposite hand, in an embodiment. In this embodiment, the thumb tab 42 may be grasped between a thumb and a finger, for example, and used to turn the ring 40 circumferentially to align the locking/unlocking mechanism. In an embodiment, a plurality of thumb tabs 42 may be provided. In an embodiment, at least two thumb tabs 42 are disposed on opposite sides of the ring 40.

In an embodiment, on its upper end, the slide ring 40 comprises a post 52 comprising a neck 44 and a head 46 (see FIG. 3). In an embodiment, the post 52 (more particularly, the neck 44 of the post 52) extends upwardly from the thickened region 62 of the slide ring 40. In an embodiment, the neck 44 comprises an elongated extension, extending from the upper side 48 of the slide ring 40. In an embodiment, the neck 44 may be generally cylindrical. Any shape or configuration of the neck may be encompassed within the invention, however. In an embodiment, the neck 44 may comprise a rectangular prism, a three-dimensional oval, or a three-dimensional triangle, for example. The horizontal cross section of the neck 44 may comprise a circle, oval, ellipse, square, rectangle, triangle or any other shape known in the art. The sidewalls of the neck 44 may be parallel in a vertical cross section. The neck 44 may be narrower than the head 46 in an embodiment. The neck 44 may have a diameter which is smaller than the head 46 in an embodiment.

In an embodiment, the neck 44 is parallel with the sidewall 16 of the container 10. In an embodiment, the neck 44 may have an internal surface 64 and an external surface 66. In this embodiment the external surface 64 of the neck 44 may be continuous with the external surface 41 of the ring. The neck 44 may additionally have a cross-sectional thickness which is less than that of the lower portion of the ring 40. In an embodiment, the cross-sectional thickness of the neck 44, between its internal surface 64 and external surface 66, is less than the thickness of the ring 40, in either or both of the parallel region 60 and the thickened region 62.

In an embodiment, the head 46 may be generally spherical, cylindrical, rectangular, square, ovular, elliptical, triangular, or any other shape known in the art. In an embodiment, the head 46 is wider than the neck 44. In an embodiment, the head 46 has a diameter which is greater than that of the neck 44. In an embodiment, the head 46 may be sized and configured such that it cannot pass through the neck receiving portion 30 of the track. In an alternate embodiment, the head 46 may be sized and configured such that it can pass through the neck-receiving portion 30 via insertion through the neck-receiving portion 30 (i.e. a snap-fit), but cannot be removed from the track 28 by pulling through the neck-receiving portion 30 in the reverse direction (i.e. a triangular head with one point of the triangle positioned vertically upward).

In an embodiment, the post 52 (and neck 44 and head 46) is not circumferential about the entirety of the slide ring. In other embodiments, the post 52, neck 44, and head 46 are circumferential about the entirety of the slide ring. In an embodiment, the post 52, neck 44, and head 46 are positioned in a singular position along the circumference of the slide ring 40. In an embodiment, a plurality of posts 52 are positioned along the circumference of the slide ring 40. In an embodiment, at least two posts 52 are positioned along the circumference of the slide ring 40. In an embodiment, at least three posts 52 are positioned along the circumference of the slide ring 40. In an embodiment, the post(s) 52 (comprising the neck 44 and the head 46) comprise a rail system 45. In an embodiment, the vertical position of the thumb tab(s) 42 is aligned with the position of one or more posts 52.

As noted, the slide ring 40 has an external surface 41 and an internal surface 43. In an embodiment, the internal surface 43 of the slide ring 40 is disposed adjacent the outer surface of the sidewall 16. In an embodiment, the slide ring 40 additionally comprises a stop 47. The stop 47 may comprise any structure known in the art that stops the slide ring 40 from being removed upwardly over the rim 13 of the container. In an embodiment, the stop 47 may be a ridge, bump, extension, or the like, which prevents the slide ring 40 from moving past the rim 13 of the container 10 when the slide ring 40 is urged upwardly. The stop 47 may be disposed on the internal surface 43 of the slide ring 40, in an embodiment. In the embodiment shown, the stop 47 comprises a plateau or ridge extending horizontally from the inner surface 43 of the slide ring 40 toward the central portion of the slide ring 40. In this embodiment, the stop 47 is horizontal or substantially horizontal and is adjacent the neck 44 of the post 52. In an embodiment, the stop 47 and the neck 44 meet at an angle which is approximately ninety degrees (90°). In the embodiment shown, as the slide ring 40 is urged upwardly, the stop 47 contacts the rim 13 of the container. The stop 47 cannot move past the rim 13 and, accordingly, the slide ring 40 cannot be removed from the container in this manner. If the ring 40 and lid 20 are in a locked position (see FIG. 3), pulling upwardly on the lid 20 would have the same result—the stop 47 of the ring 40 would prevent the user from removing either the locked lid 20 or the ring 40 from the container 10.

In an embodiment, the container assembly has a locked position (see FIG. 3) and an unlocked position (see FIG. 4). In the locked position, the post(s) 52 is disposed within the track 28 such that the head 46 cannot move downwardly through the neck-receiving portion 30. In this embodiment, the post 52 is within a retention point or region 54 of the track 28. There may be a plurality of retention points or regions 54 within the track. In this locked position, if the lid 20 is pulled upwardly, the head 46 remains within the head-receiving portion 32 and cannot move through the narrower neck-receiving portion 30. In use, at least one of the lid 20 or the ring 40 must be rotated circumferentially to move the head 46 into alignment with the insertion point 50 of the track 28. Once the proper alignment of the lid 20 and the ring 40 has been achieved (see FIG. 4), such that the head 46 is in alignment with the insertion point 50 of the track 28, the head can be removed from the track 28, through the insertion point (see FIG. 6B). In this embodiment, the lid 20 may be lifted away from the head 46 and ring 40 and/or the ring 40 may be lowered to separate the ring from the lid 20.

In an embodiment, when the lid 20 and ring 40 are in the locked position, the lid 20 and the ring 40 may freely rotate circumferentially together, in unison, in this locked manner. In an embodiment, when the lid 20 and ring 40 are in the locked position, the fit between the post 52 and the track 28 may be snug such that they are stationary or rotate circumferentially together, in unison. In this embodiment, the fit is snug enough that the lid 20 and the ring 40 do not circumferentially rotate separately without applied forces. In other embodiments, the lid 20 and the ring 40 may rotate separately, in the same direction but different distances, in opposite directions, or one may be held in place while the other rotates. In an embodiment, when the lid 20 and ring 40 are locked, access to the container contents is not possible.

In an embodiment, a user must align certain visual elements disposed on the exterior of the ring 40 and/or lid 20 in order to align the head 46 is with the insertion point 50 of the track 28 and unlock the system. For example, the visual elements may comprise colors that have to be matched, shapes that have to be matched, letters that have to be matched, or images that have to be matched. In an embodiment, a written code (i.e. "align F and B" or "align 1 with 8") is printed on the lid 20, sidewall 16, and/or ring 40, directing the user to align certain elements to unlock the system. The code and/or visual elements may be printed onto the exterior surface of the lid 20, sidewall 16, and/or ring 40 in an embodiment. In other embodiments, the code and/or visual elements may be imprinted into (i.e. formed with) the exterior surface of the lid 20, sidewall 16, and/or ring 40.

To properly align the elements per the code, a user may grip the thumb tab(s) 42 of the ring 40, which retain the ring 40 in position, and may twist the lid 20 until the correct alignment is achieved. Likewise, the lid 20 may be held in place and the ring 40 may be twisted to achieve the proper alignment. In an embodiment, the visual elements which solve the code are printed or otherwise disposed in alignment with the head 46 and the insertion point 50 of the track 28.

To form the inventive container system, a cylindrical container may be formed using methods known in the art, such as spiral winding with a rolled rim 13 or separate application of a rim 13. The ring 40 may be formed via any method known in the art, such as via thermoforming techniques. The ring 40 may be placed onto the container sidewall 16 prior to application of the bottom end 18 in an embodiment. If a rim 13 is separately applied, it may be applied before or after placement of the ring 40. The lid 20 may be affixed to the container as a final step after the container has been filled, either through its bottom or top end.

Many modifications and other embodiments of the present disclosure set forth herein will come to mind to one skilled in the art to which the present disclosure pertains having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A container system comprising:

a container body having a base, at least one sidewall extending upwardly from the base, and a rim disposed opposite the base, wherein the rim defines an open end of the container;

a lid configured to close the open end of the container, wherein the lid comprises:

a track disposed at least partially circumferentially within a peripheral portion of the lid;

at least one insertion point within the track; and at least one retention region within the track;

a ring disposed circumferentially about the at least one sidewall, between the rim and the base, wherein the ring comprises at least one post which is configured to be inserted into and removed from the at least one insertion point and retained within the retention region;

wherein the at least one post comprises a neck and a head and wherein the head is larger than the neck; and wherein the track comprises a neck-receiving portion and a head-receiving portion and wherein the head-receiving portion is larger than the neck-receiving portion; and wherein at least one of the ring and the lid are circumferentially rotatable between a locked position, wherein the at least one post is within the at least one retention region and an unlocked position, and wherein the at least one post is within the at least one insertion point.

2. The container system of claim 1 wherein the insertion point comprises a neck-receiving portion which is at least the same size as the head-receiving portion.

3. The container system of claim 1 wherein the retention region comprises a neck-receiving portion and a head-receiving portion and wherein the head-receiving portion is larger than the neck-receiving portion.

4. The container system of claim 1 comprising one post and one insertion point.

5. The container system of claim 1 comprising two posts and two insertion points.

6. The container system of claim 1 wherein the ring additionally comprises at least one thumb tab extending therefrom.

7. The container system of claim 6 wherein the ring comprises two thumb tabs on opposite sides of the ring.

8. The container system of claim 1 wherein the ring comprises a stop which prevents movement of the ring vertically over the rim.

9. The container system of claim 1 wherein the ring and the lid comprise visual elements which indicate the correct alignment of the at least one post and the at least one insertion point.

10. The container system of claim 9 wherein a visual element on the ring must be aligned with a visual element on the lid to align the at least one post and the at least one insertion point.

11. Container system of claim 1 wherein the sidewall is cylindrical, the ring is cylindrical, and the lid is a disc.

12. The container system of claim 11 wherein the ring is circumferentially rotatable about the sidewall.

13. The container system of claim 11 wherein the ring is vertically movable about the sidewall when the system is in an unlocked position.

14. The container system of claim 11 wherein each of the ring and the lid are circumferentially rotatable about the sidewall and can rotate in unison or separately.

15. The container system of claim 14 wherein the track is disposed radially outward of the sidewall.

16. A lidded locking mechanism comprising:

a lid configured to close the open end of a container, wherein the lid comprises:

a track disposed at least partially circumferentially within a peripheral portion of the lid;

at least one insertion point within the track; and at least one retention region within the track;

a ring configured to be disposed circumferentially about the container, wherein the ring comprises at least one post which is configured to be inserted into and removed from the at least one insertion point and retained within the retention region;

wherein the at least one post comprises a neck and a head and wherein the head is larger than the neck; and wherein the track comprises a neck-receiving portion and a head-receiving portion and wherein the head-receiving portion is larger than the neck-receiving portion; and wherein at least one of the ring and the lid are circumferentially rotatable between a locked position, wherein the at least one post is within the at least one retention region and an unlocked position, and wherein the at least one post is within the at least one insertion point.

17. The lidded locking mechanism of claim 16 wherein the track is vertically aligned with the post.

* * * * *